US007617845B2

(12) United States Patent
Drope et al.

(10) Patent No.: US 7,617,845 B2
(45) Date of Patent: Nov. 17, 2009

(54) HEALD SHAFT

(75) Inventors: Stefan Drope, Albstadt (DE); Johannes Bruske, Albstadt (DE); Karl-Heinz Gesing, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 54 days.

(21) Appl. No.: 11/474,334

(22) Filed: Jun. 26, 2006

(65) Prior Publication Data

US 2007/0006930 A1 Jan. 11, 2007

(30) Foreign Application Priority Data

Jun. 24, 2005 (DE) ..... 10 2005 029 699

(51) Int. Cl.

| | |
|---|---|
| ***D03C 9/06*** | (2006.01) |
| ***D03C 9/00*** | (2006.01) |
| *D03C 9/04* | (2006.01) |
| *D03C 9/02* | (2006.01) |

(52) U.S. Cl. ..... 139/91; 139/1 E; 139/55.1; 139/82; 139/83; 139/84; 139/87

(58) Field of Classification Search ..... None
See application file for complete search history.

(56) References Cited

U.S. PATENT DOCUMENTS

| | | | | | |
|---|---|---|---|---|---|
| 2,485,414 | A * | 10/1949 | Ruesch | 139/364 |
| 3,335,759 | A * | 8/1967 | Koch | 139/91 |
| 4,022,252 | A * | 5/1977 | Ogura | 139/91 |
| 4,355,667 | A * | 10/1982 | Shimizu | 139/91 |
| 4,460,022 | A * | 7/1984 | Sherrill | 139/369 |
| 4,877,060 | A * | 10/1989 | Froment et al. | 139/82 |
| 5,004,019 | A * | 4/1991 | Blontrock | 139/91 |
| 5,249,605 | A * | 10/1993 | Graf | 139/91 |
| 5,297,589 | A * | 3/1994 | Baumann | 139/91 |
| 5,411,061 | A | 5/1995 | Faase | |
| 5,483,996 | A * | 1/1996 | Mettler | 139/91 |
| 5,887,629 | A * | 3/1999 | Mettler et al. | 139/91 |
| 6,926,042 | B2 * | 8/2005 | Scheiwe | 139/91 |
| 7,032,624 | B2 * | 4/2006 | Bruske et al. | 139/57 |
| 7,114,528 | B2 * | 10/2006 | Schmid et al. | 139/92 |
| 7,500,495 | B2 * | 3/2009 | Bruske et al. | 139/87 |
| 2005/0051228 | A1 * | 3/2005 | Bruske et al. | 139/55.1 |
| 2005/0081942 | A1 * | 4/2005 | Schwane et al. | 139/92 |
| 2006/0144459 | A1 * | 7/2006 | Bruske et al. | 139/93 |

(Continued)

FOREIGN PATENT DOCUMENTS

| | | |
|---|---|---|
| CH | 643 310 | 12/1978 |

(Continued)

*Primary Examiner*—Bobby H Muromoto, Jr.
(74) *Attorney, Agent, or Firm*—Fitch, Even, Tabin & Flannery; Norman N. Kunitz

(57) ABSTRACT

A heald shaft (1) for coupling the shaft rods (2) with the end binders (5), having connecting joints or hinges (10) whose pivot axes (14) lie externally of the shaft rods (2) and preferably inside the end binders (5). Due to the connecting joints (10), a moment-free coupling between the shaft rods (2) and the end binders (5) is ensured. The relative pivotal motions between the shaft rods (2) and the end binders (5) appearing during operation do not generate any moment transmissions between the shaft rods (2) and the end binders (5). Preferably, the driving couplers (7) are arranged above the end binders (5) in a direct extension thereof.

20 Claims, 4 Drawing Sheets

U.S. PATENT DOCUMENTS

| | | | | |
|---|---|---|---|---|
| 2007/0006931 | A1 * | 1/2007 | Bruske et al. | 139/11 |
| 2007/0009319 | A1 * | 1/2007 | Drope et al. | 403/11 |
| 2008/0053555 | A1 * | 3/2008 | Cabulla et al. | 139/57 |

FOREIGN PATENT DOCUMENTS

| | | | |
|---|---|---|---|
| CH | 643 310 | | 5/1984 |
| DE | 44 03 923 | | 7/1995 |
| JP | S52-127181 | U | 9/1977 |
| JP | 59 -73382 | | 5/1984 |
| JP | S63-033063 | U | 3/1988 |
| JP | 10-310948 | | 11/1998 |
| JP | 10 310948 | | 11/1998 |
| JP | 2001-064843 | | 3/2001 |
| JP | 2001-064843 | A | 3/2001 |
| WO | WO02/29143 | | 4/2002 |

* cited by examiner

HEALD SHAFT

CROSS REFERENCE TO RELATED APPLICATION

This application claims the priority of German Patent Application No. 10 2005 029 699.8-26, filed on Jun. 24, 2005, the subject matter of which, in its entirety, is incorporated herein by reference.

BACKGROUND OF THE INVENTION

The invention relates to a heald shaft having shaft rods and end binders.

As rule, heald shafts comprise two spaced, mutually parallel held shaft rods which, at their ends, are connected to one another by end binders. In the position of rest, the end binders and the shaft rods form a rectangular frame. The shaft rods are provided with shaft staves which support healds. Each heald has at least one yarn-guiding eyelet through which a warp yarn passes.

During the weaving process, the heald shafts are, for shed-building, rapidly reciprocated vertically, whereby large dynamic loads are generated.

U.S. Pat. No. 4,022,252 describes a heald shaft having a rigid connection between the two vertically oriented end binders and the two horizontal shaft rods. During the upward and downward motions the shaft rods bend upward and downward. The shaft rods transmit such a bending through the rigid corner connection to the end binders, which, as a result, are bent in an S shape.

Since a bending of the end binders has been considered disadvantageous, attempts have been made to avoid such an occurrence. For this purpose, Japanese Patent No. 59-73382 discloses a jointed corner connection between end binder and shaft rod. The jointed corner connection is provided by a connecting joint situated inside the shaft rod. A projection extends from the end binder into the inner space thereof where it surrounds a bearing pin.

In such a basic configuration the bending of the shaft rod is not transmitted directly to the end binder. The latter has to take up only those bending moments which are generated by the introduction of forces from the shaft rod into the projection extending away from the end binder. At high dynamic loads this arrangement likewise results in a dynamic bending of, or loads on, the end binders.

Further, Japanese Patent No. 10-310948 discloses a heald shaft, whose end binders and shaft rods are connected to one another by connecting joints. The pivot axes of the connecting joints pass approximately centrally through the end binders. The connecting joints comprise spring elements which impose the 90° position on the connecting element and rapidly reset any deviation from such a 90° position.

The spring elements introduce forces into the end binders as soon as the shaft rod bends under dynamic loads.

The Japanese Patent No. 10-310948 further describes a direct drive of the heald shaft by driving couplers which are applied either to the end binders or to the lower shaft rod. In case the driving couplers are applied to the end binders, the force introduction into the end binders is effected by a linear motor or laterally projecting arms.

It is an object of the invention to improve a heald shaft regarding its dynamic design.

SUMMARY OF THE INVENTION

The above object is achieved with a heald shaft as defined in claim 1 as well as with a heald shaft as defined in claim 2.

The heald shaft according to the invention as defined in claim 1 comprises at least one shaft rod and at least one end binder connected to one another by a connecting joint. The latter defines a pivot axis which is situated externally of the shaft rod and which is free from resetting forces. The connecting joint defines a preferably 90° angle and allows a pivot range of a few degrees, for example, ±3°, ±5° or ±10°. Within such a pivot range no resetting forces appear. Any pivotal position imparted to the connecting joint remains preserved. In this manner no transmission of bending moments between the shaft rod and the end binder can take place. The connecting joint is constituted as a low-friction slide bearing, having a preferable material pair of steel/steel, steel/plastic or a combination of steel/plastic/steel. Since the pivotal axis is situated externally of the shaft rod, acceleration and deceleration forces between end binder and shaft rod are transmitted to a line which lies adjacent or within the end binder. As a result, such acceleration forces cannot generate appreciable bending moments in the end binder.

The combination of the features, according to which the structure is free from resetting forces and the pivotal axis is situated externally of the shaft rod, results in the possibility to impart high dynamic loads to the heald shaft without adversely affecting the end binders and to reduce the load thereon.

Further, as defined in claim 2, it is advantageous to provide, at the end binder, a driving coupler which introduces a force whose direction or vector lies within the end binder. Here too, the pivot axis of the connecting joint lies externally of the shaft rod. In this manner dynamic loads, which may be generated by the introduction of driving forces into the end binder, as well as dynamic loads which may appear because of the transmission of driving forces from the end binder to the shaft rod are reduced. The end binders are thus essentially exposed to traction and pressure, but to essentially no bending, making feasible a relatively light-weight structure of the end binders.

The end binders may be, for example, bent sheet metal components, permitting a sufficiently accurate manufacture, from which there are omitted milling or other processes which would introduce into the material of the end binders forces released upon the finishing work. The sheet metal component is preferably a U-shaped profile, whose inner space is open toward the shaft rods. It may, however, also be a tubular profile or a two-shell component, whose two halves are connected to one another, for example, by rivets.

The connecting joint comprises a bearing body which is preferably attached to the end binder and whose outer surface then constitutes a slide surface or bearing surface. The bearing body may be entirely disposed in the inner space of the end binder. In case the bearing body has a slightly larger diameter, it is, however, preferable for allowing it to project from the inner space of the end binder. Such an arrangement minimizes dynamic surface loads on the bearing body.

The connecting joint further comprises a coupling element which is pivotally supported on the bearing body and which, for example, partially or entire straddles or surrounds the bearing body. The coupling element preferably has a bar which extends into the shaft rod, where it is releasably connected, preferably by friction. For a releasable connection, a clamping device may be used which firmly clamps the coupling element in a hollow space of the shaft rod. The bar preferably has parallel flanks, that is, it is bordered by mutually parallel surfaces.

The coupling element may be optionally provided with a leg which extends into the inner space of the end binder. In this manner the coupling element thus constitutes a two-arm lever. In the alternative, the coupling element may be a T-shaped component.

The leg which extends into the end binder is essentially parallel to the end binder and it may assume several functions. For example, it may be provided with a buffer element for limiting the pivot angle of the connecting joint at least in one pivotal direction. In this manner, in case of a rectangular heald shaft having a total of four connecting joints, the obtainable pivot angle is limited at the four corners of the rectangle. While, for example, the buffer element of one connecting joint limits the pivot angle to more acute angles, at the same time this effects a limitation of the pivot angle at the connecting joint situated at the other end of the shaft rod to more obtuse angles. In this manner the one-sided pivot angle limitations of the two connecting joints situated at opposite ends of a shaft rod result, in coordination, in a limitation of the pivot angle at both sides. Within the angular range, however, no resetting forces appear, at least none which could overcome the bearing friction of the connecting joint.

The buffer element may also include a projection which serves as a heald stop for ensuring that the healds are securely held on the shaft staves as soon as the end binders are mounted.

In a preferred embodiment, the force-introducing device of the driving coupler and the connecting joint are disposed not only within the cross-sectional profile enclosed by the end binder, but are also situated on the longitudinal central axis of the end binder. The longitudinal central axis is defined by the surface center of gravity of the cross-sectional profile and represents the line along which a force introduction into the end binder in the longitudinal direction generates no bending moment.

Further details of advantageous embodiments of the invention form subjects of the drawing, the description or the claims. Two embodiments of the invention are illustrated in the drawings.

DETAILED DESCRIPTION OF THE INVENTION

Figure 1:
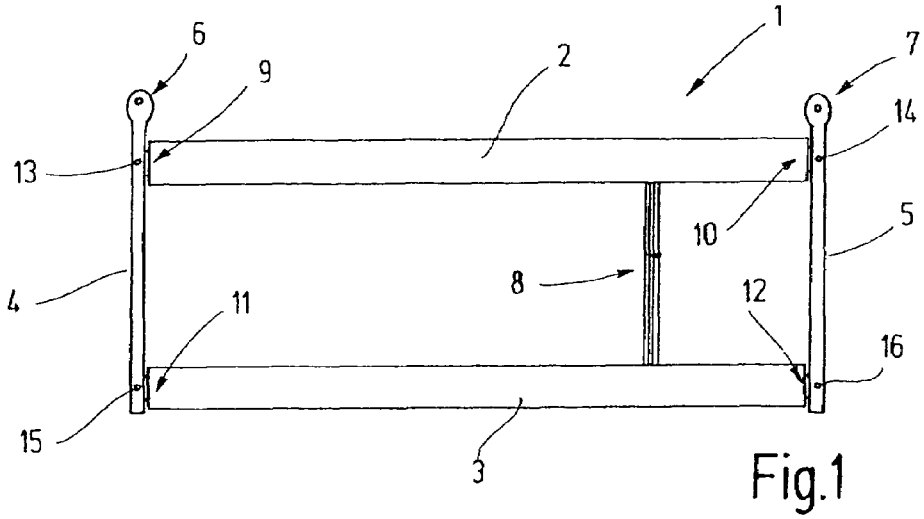
FIG. 1 is a side elevational view of a heald shaft according to the invention.

FIG. 1 illustrates a heald shaft 1 which serves for the shed formation in a textile machine. The heald shaft 1 comprises upper and lower shaft rods 2, 3 which are extruded, hollow-chamber aluminum profiles and which are oriented horizontally and parallel to one another. At their ends the shaft rods 2 and 3 are interconnected by end binders 4, 5 which, for example, at their upper end, are connected with driving couplers 6, 7. The latter form part of a coupling device for establishing a connection with a mechanical drive.

The shaft rods 2, 3 are provided with shaft staves which support healds 8 for guiding the warp threads. FIG. 1 shows merely a few healds; the heald group, however, extends from one end of the shaft rods 2, 3 to the respective other end thereof.

For connecting the shaft rods 2, 3 with the end binders 4, 5, connecting joints 9, 10, 11, 12 are provided which establish, between the respective shaft rod 2, 3 and the end binder 4, 5, a jointed connection, that is, a coupling which is pivotal only about one axis. The connecting joints 9-12 define pivot axes 13, 14, 15, 16 which are arranged externally of the shaft rods 2, 3 and preferably inside the end binders 4, 5.

The connecting joints 9-12 permit a free pivotal motion in a limited pivotal range between the shaft rods 2, 3 and the end binders 4, 5. Spring elements or similar other elements, which could be used for preventing or opposing a pivotal motion of the connecting joints 9-12, are absent.

Figure 2:
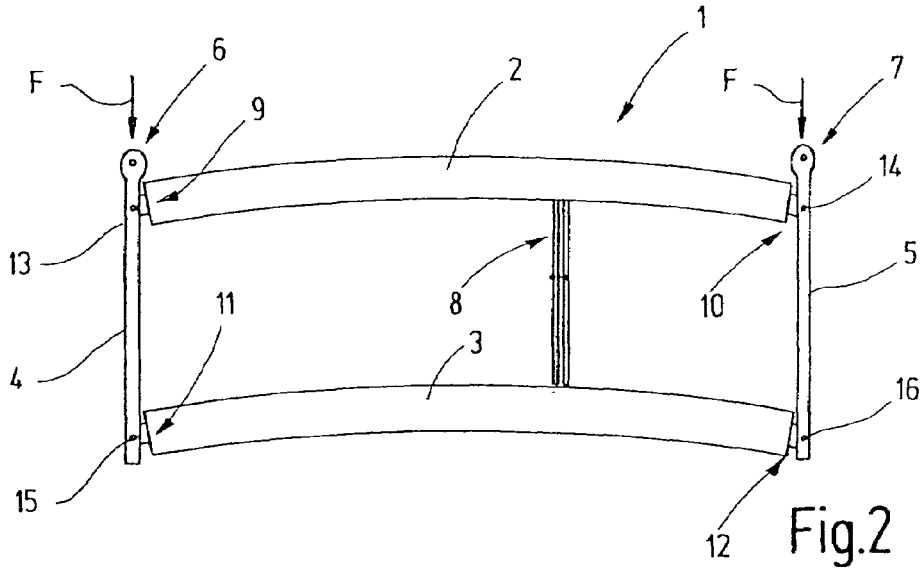
FIGS. 2, 3 are side elevational views of the heald shaft shown in FIG. 1 as they are submitted (in an exaggerated showing) to a dynamic load.
Figure 3:
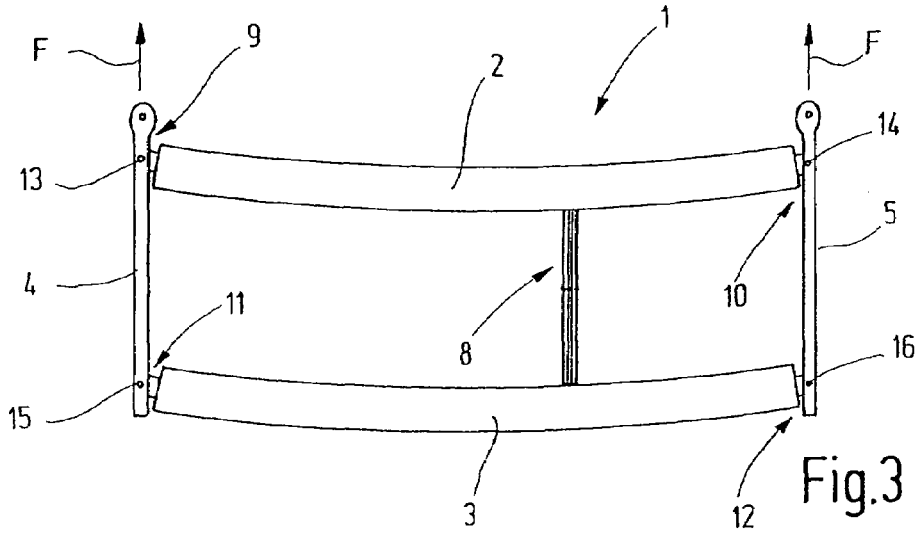

The heald shaft described up to this point operates as follows (reference is being made to FIGS. 2 and 3):

During operation, through the driving couplers 6, 7 forces are introduced which are symbolically shown by vectors F in FIGS. 2 and 3. The forces are applied to the driving devices 6, 7 as shown by the vectors F which lie inside the profile surrounded by the cross section of the end binders 4, 5. The forces therefore cause no bending or kink deformations of the end binders 4, 5.

Similarly, the pivot axes 13, 14, 15, 16 lie inside the above-noted profile enclosed by the end binders 4, 5. In this manner, the driving force symbolized by the vector F is transmitted directly in the longitudinal direction of the end binders 4, 5 from the driving coupler 6, 7 to the respective connecting joint 9-12. The shaft rods 2, 3 may deform under the dynamic load as shown. Such a deformation, however, is not transmitted to the end binders 4, 5. Neither the connecting joints 9, 10, 11, 12 nor other elements effective between the end binders 4, 5 and the shaft rods 2, 3 transmit a bending moment. Further, by virtue of the approximately central introduction of the driving forces into the end binders 4, 5 and because of the approximately central force application to the connecting joints 9, 10, 11, 12, a generation of bending moments are avoided which benefits the guidance of the end binders 4, 5. This arrangement may work with a very small clearance and thus with a very high accuracy. This applies to the downward motion of the heald shaft 1 shown in FIG. 2.

Similar considerations apply to the upward motion of the heald shaft 1, illustrated in FIG. 3. Here too, the forces introduced into the driving couplers 6, 7 and symbolically shown by vectors F lie within the cross-sectional profile of the end binders 4, 5. The direction of the vectors F is essentially in alignment with the vectors of force introduction which act upon the pivot axes 13-16. In this manner no dynamic loads are imparted to the end binders 4, 5, either during the downward motion or the upward motion of the heald shaft 1. Rather, the end binders 4, 5 are exclusively or almost exclusively exposed to traction and pressure.

Figure 4:
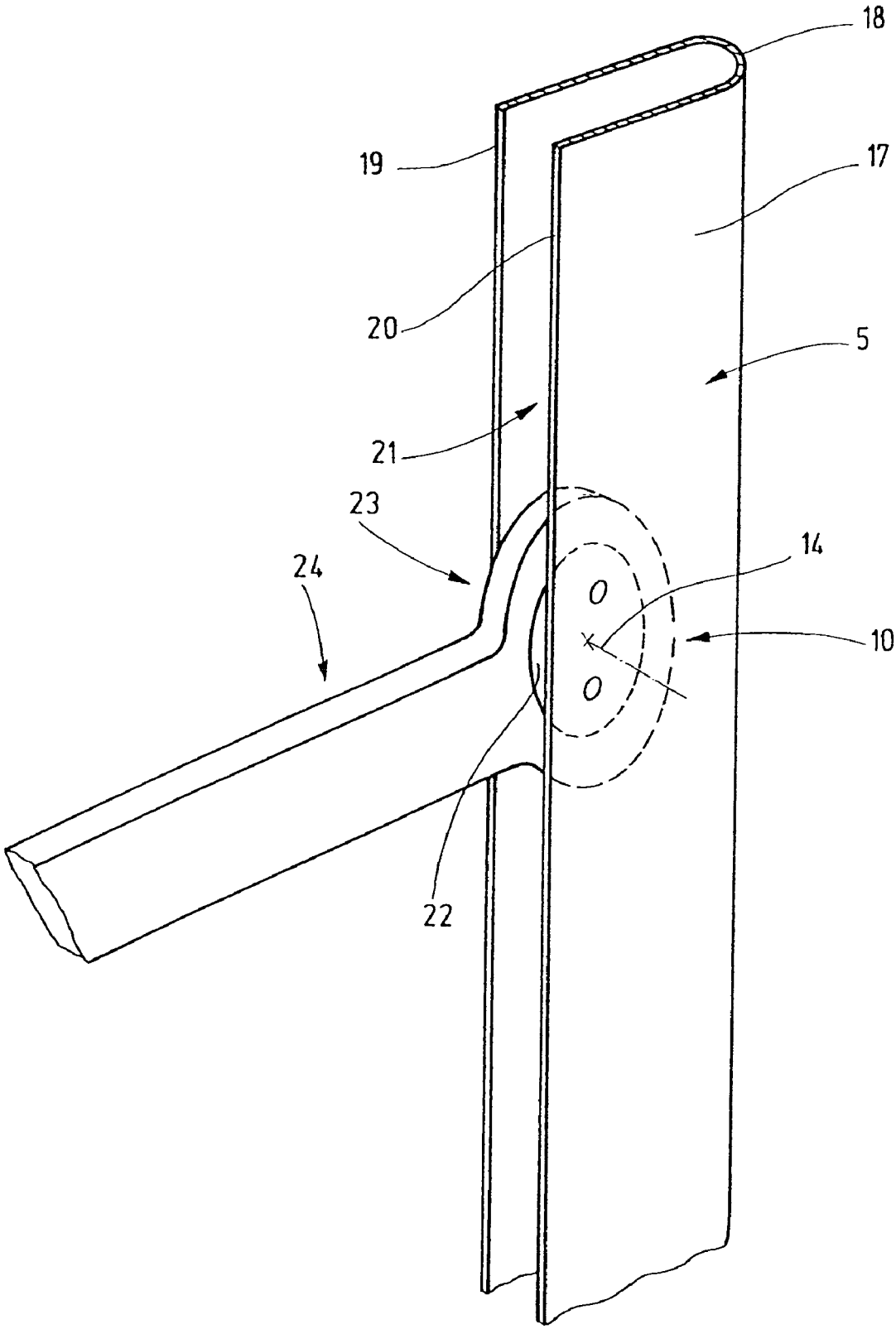
FIG. 4 is a simplified illustration of a simple embodiment of the connecting joint for linking the end binder with the shaft rod.

FIG. 4 shows a fragmentary view of the end binder 5, also representing the end binder 4. Its basic body 17 is, as seen, a bent sheet metal component having a U-shaped cross section. Two parallel-spaced legs 19, 20 extend from the back 18 which is faces away from the shaft rods. The legs 19, 20 define the flat sides of the end binder 5 and also define an inner space 21. The latter is preferably free from inner parts, and is thus hollow along its entire vertical dimension. If required, the inner space may be filled entirely or in sections with a foam or a honeycomb profile, or an oscillation-absorbing or oscillation-dampening material.

FIG. 4 further shows the connecting joint 10 which comprises a bearing body 22 and a coupling element 23. The bearing body 22 is, for example and preferably, a flat cylinder whose bottom and top surfaces lie against the respective legs 19, 20 and are attached thereto, for example, by welding. The bearing body 22 is, for example of steel. It may be disposed fully within the inner space 21 of the end binder 5. In case no sufficient room is available for such an arrangement, the bearing body 22 may partially project from the inner space 21. Its central axis defines the pivot axis 14 of the connecting joint 10. The pivot axis 14 intersects the legs 19, 20.

The coupling element 23 fully or partially surrounds the bearing body 22. In the illustrated embodiment the coupling element 23, which may be steel, has a cylindrical bore with which it sits on the bearing body 22. In this manner a steel/steel material pairing is obtained. Between the coupling element 23 and the bearing body 22 a plastic bushing may be provided, in which case a steel/plastic/steel combination is obtained. In this arrangement it is advantageous to provide that the plastic bushing is not attached to either the coupling element 23 or the bearing body 22. The coupling element 23 and the bearing body 22 are rotatable relative to one another with low friction, while the fit has no appreciable play.

Figure 5:
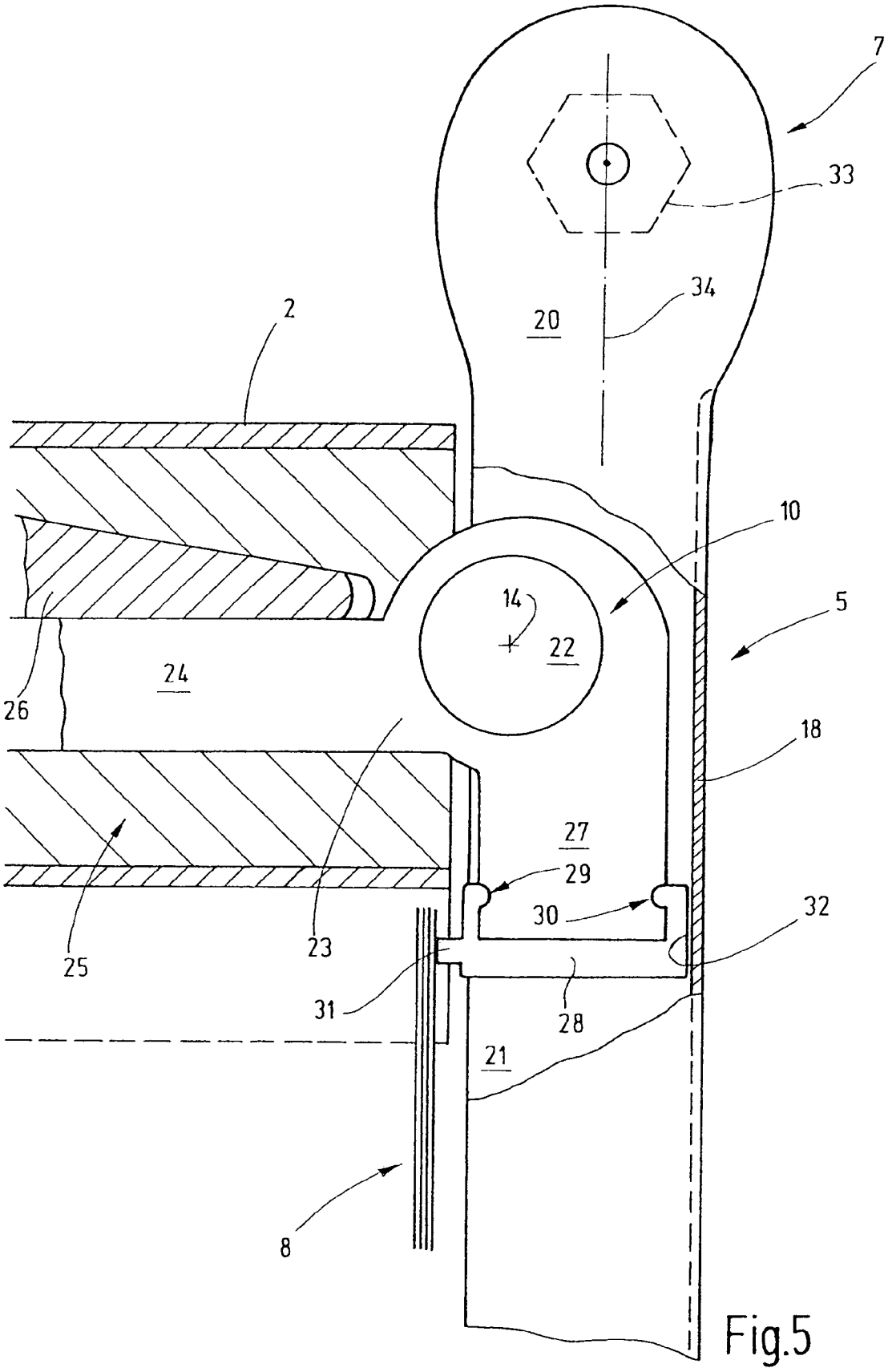
FIG. 5 is a fragmentary, partially sectional basic illustration of the shaft rod and the end binder with the connecting joint.

A bar 24 extends from the coupling element 23 and serves, as illustrated particularly in FIG. 5, for coupling the connecting joint 10 with the shaft rod 2. The latter is, for example, an extruded aluminum profile having a longitudinally extending hollow space. The bar 24 projects into the hollow space and is held there by a clamping device 25 which is, for example, of plastic and which comprises a wedge 26 that may biased against the bar 24 by non-illustrated actuating means.

The coupling element 23, as shown in FIG. 5, is preferably a two-arm lever having a leg 27 which extends into the inner space 21 of the end binder 5 and which is oriented preferably approximately parallel to the length direction of the end binder 5. The leg 27 may carry at its free end a buffer element which may be, for example, of plastic. The coupling element 23 which preferably has an overall thickness only slightly less than the distance between the legs 19, 20 from one another, has at its narrow sides notches 29, 30 into which extend corresponding lugs of the buffer element 28 for supporting the latter. The buffer element 28 may have a projection 31 which extends from the inner space 21 underneath the shaft rod 2 in the region where the healds 8 are held. The projection 31 thus constitutes a heald stop which prevents the healds 8 from sliding off the shaft stave (not shown) held on the shaft rod 2. The projection 31 has a length which ensures that such an effect occurs independently from the momentary pivotal angle.

At the opposite side, the buffer element 28 may be provided with a seating surface 32 for limiting the pivot angle of the connecting joint 10. The seating surface 32 is in engagement with the back 18 of the end binder 5.

The pivotal angles of the individual connecting joints 9-12 limited by the seating surfaces 32 are greater than the pivotal excursion of the respective connecting joint 9-12 when bending of the respective shaft rod 2, 3 occurs. In this manner a transmission of bending moments from the shaft rods 2, 3 to the end binders 4, 5 is prevented. Furthermore, a manipulation of the assembled heald shaft 1 is facilitated and may take place without an excessive deformation, that is, without an excessive deviation from the rectangular shape of the heald shaft 1.

As it may be further seen in FIG. 5, the driving coupler 7 is disposed in the immediate axial vicinity of the end binder 5, in the axial extension thereof and forms therewith a one-piece construction. By one-piece construction there is meant a seamless structure made of one and the same material, as well as an inseparable attachment of two parts, particularly by means of a weld seam. The driving coupler may have a body 33 which has a hexagonal outline and which is held, for example, rotatably, between the legs 19, 20. The rotary axis of the body 33 lies preferably on the longitudinal axis 34 of the end binder 5. In a certain sense the longitudinal axis 34 represents a neutral axis. Forces which are introduced in the direction of the central axis 34 into the end binder 5 do not result in bending, but rather in a traction and pressure load on the end binder 5. The longitudinal central axis 34 is preferably defined such that it passes through the center of gravity of the surface of the cross-sectional profile. The pivot axis 14 too, is preferably arranged on the longitudinal central axis 34. As shown in FIG. 5, however, it may be slightly laterally offset with respect to the longitudinal central axis 34.

Figure 6:
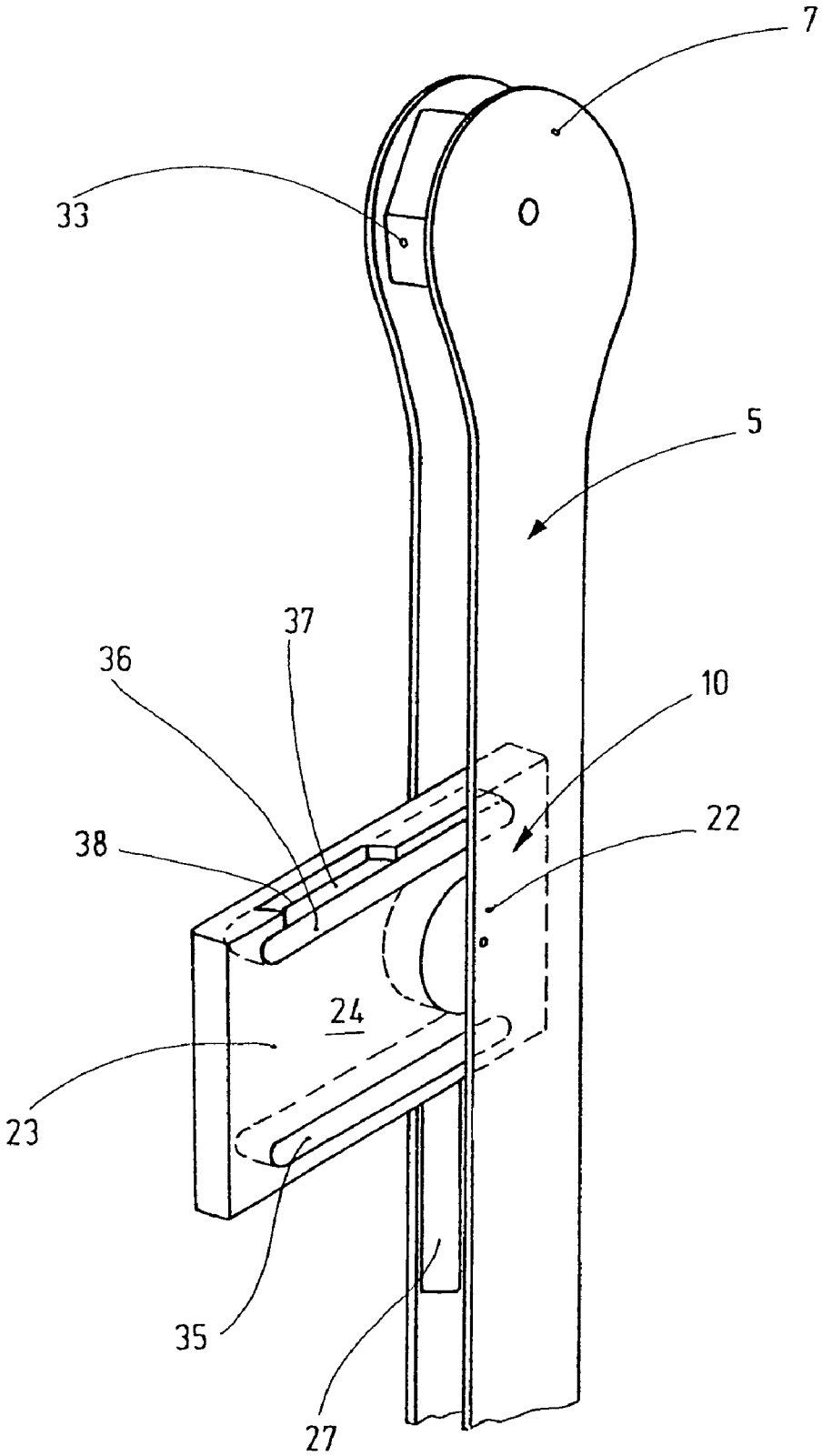
FIG. 6 is a fragmentary, partially sectional basic illustration of a special embodiment of the connecting joint.

FIG. 6 shows a modified embodiment of the connecting joint 10, particularly of the bar 24 of the coupling element 23, while using the same reference numerals as those used in the description of the embodiment of FIGS. 1 to 5, inasmuch as they have the same or sensibly the same meaning. The coupling element is preferably of plastic which, on the one hand, encircles the bearing body 22 of the end binder 5 and, on the other hand, projects with its bar 24 into the inner space 21 of the shaft rod 2 and is attached thereto preferably by a screw. It has been found advantageous to strengthen the plastic bar 24 of the coupling element 24 by respective stiffening elements 35, 36 along its upper and lower edges. The stiffening elements 35, 36 are preferably made of steel. They extend from the hollow space of the shaft rod 2 into the inner space 21 of the end binder 5 to a location which is beyond the center point of the bearing body 22. For fixing the coupling element 23 to the shaft rod 2, the bar 24 is hollowed out, so that a non-illustrated conventional securing means, which exerts a force on the steel elements 35, 36 through the shaft rod 2, affixes the coupling element 23 to the shaft rod 2. The recess 38 exposes a clamping surface 37 for a tightening screw.

The coupling element 23 of FIG. 6 is, as in the previous embodiment, formed as a two-arm lever. The leg 27, carrying the buffer element 28 which extends into the inner space 21 of the end binder 5 is only schematically indicated in FIG. 6; the description in conjunction with FIG. 5 applies.

The heald shaft according to the invention has, for coupling the shaft rods 2, 3 with the end binders 4, 5, connecting joints 9-12 whose pivot axes 13-16 lie externally of the shaft rods 2, 3 and preferably inside the end binders 4, 5. By means of the connecting joints 9-12 a moment-free coupling between the shaft rods 2, 3 and the end binders 4, 5 is ensured. The relative pivotal motions between the shaft rods 2, 3 and the end binders 4, 5 appearing during operation do not generate any moment transmissions between the shaft rods 2, 3 and the end binders 4, 5. According to a preferred embodiment the driving couplers 6, 7 are arranged above the end binders 4, 5 in a direct extension thereof.

List of Reference Characters:

| | |
|---|---|
| 1 | heald shaft |
| 2,3 | shaft rods |
| 4,5 | end binders |
| 6,7 | driving couplers |
| 8 | healds |
| 9,10,11,12 | connecting joints |
| 13,14,15,16 | pivot axes |
| 17 | basic body |
| 18 | back |
| 19,20 | legs |
| 21 | inner space |
| 22 | bearing body |
| 23 | coupling element |

-continued

| List of Reference Characters: | |
|---|---|
| 24 | bar |
| 25 | clamping device |
| 26 | wedge |
| 27 | leg |
| 28 | buffer element |
| 29,30 | notches |
| 31 | projection |
| 32 | seating surface |
| 33 | body |
| 34 | longitudinal central axis |
| 35,36 | stiffening elements |
| 37 | clamping surface |
| 38 | recess |
| F | force vector |

The invention claimed is:

1. A heald shaft for weaving machines, comprising a shaft rod which supports healds for forming sheds, an end binder surrounding an inner space and, a connecting joint connecting an end of the shaft rod to the end binder, with the connecting joint including a pivot connecting joint member rotatable mounted on the end binder at least partially within the inner space for rotation about a pivot axis and having a bar that extends out of the inner space and is connected there to the end of the shaft rod and connecting the shaft rod and the end binder to one another so that the end binder and the shaft rod can pivot relative to one another, wherein the pivot axis is situated externally of the shaft rod, and wherein the connecting joint is free from resetting forces tending to oppose relative pivotal motion between the shaft rod and the end binder.

2. A heald shaft for weaving machines, comprising a shaft rod which supports healds for forming sheds, an end binder surrounding an inner space and, a connecting joint connecting an end of the shaft rod to the end binder, with the connecting joint including a pivot connecting joint member rotatable mounted on the end binder within the inner space for rotation about a pivot axis and having a bar that extends out of the inner space and is connected there to the end of the shaft rod and connecting the shaft rod and the end binder to one another so that the end binder and the shaft rod can pivot relative to one another, wherein the pivot axis is situated externally of the shaft rod, and further comprising a driving coupler disposed at one end of the end binder as a one-piece direct extension thereof.

3. The heald shaft as defined in claim 1, wherein the pivot axis is situated within the end binder.

4. The heald shaft as defined in claim 1, wherein the end binder has a basic body constituted by a generally U-shaped bent sheet metal component.

5. The heald shaft as defined in claim 1, wherein the end binder has a tubular basic body.

6. The heald shaft as defined in claim 1, wherein the pivot connecting joint comprises a bearing body attached to the end binder and said connecting joint member rotatably mounted on said bearing body.

7. The heald shaft as defined in claim 6, wherein the bearing body is at least partially disposed in the inner space surrounded by the end binder and is held between legs of the end binder.

8. The heald shaft as defined in claim 6, wherein the bearing body is cylindrical.

9. The heald shaft as defined in claim 6, wherein the bar of the connecting joint member extends into the shaft rod.

10. The heald shaft as defined in claim 9, wherein a clamping device is associated with the bar for coupling the bar with the shaft rod.

11. The heald shaft as defined in claim 6, wherein the connecting joint member further includes a leg extending into the inner space of the end binder.

12. The heald shaft as defined in claim 11, wherein the leg extends essentially parallel to the end binder.

13. The heald shaft as defined in claim 11, wherein the leg is, at its free end, provided with a buffer element.

14. The heald shaft as defined in claim 13, wherein on the buffer element a projection is formed which extends out of the inner space of the end binder.

15. The heald shaft as defined in claim 14, wherein the projection is formed as a heald stop.

16. The heald shaft as defined in claim 13, wherein the buffer element has at least one seating surface which can assume an abutting engagement with an inner surface of the end binder for limiting the pivot angle of the connecting joint.

17. The heald shaft as defined in claim 9, wherein the bar is attached to the shaft rod by a securing means.

18. The heald shaft as defined in claim 9, wherein the bar is of plastic and has stiffening elements.

19. The heald shaft as defined in claim 2, wherein the connecting joint is free from resetting forces tending to oppose relative pivotal motion between the shaft rod and the end binder.

20. The heald shaft as defined in claim 1, including a spaced parallel pair of said shaft rods and a spaced parallel pair of said end binders, with each end of each shaft rod being connected to a respective one of said end binders by a respective one of said connecting joints.

* * * * *